US005338245A

United States Patent [19]

Murza et al.

[11] Patent Number: 5,338,245

[45] Date of Patent: Aug. 16, 1994

[54] GIANT GUMMY BEAR

[76] Inventors: Stefan D. Murza, 3157 Reese Dr., Portsmouth, Va. 23703; George Spector, 233 Broadway, Rm. 702, New York, N.Y. 10279

[21] Appl. No.: 109,437

[22] Filed: Aug. 20, 1993

[51] Int. Cl.[5] ..... A63H 3/52; A63H 3/00; A63H 3/36

[52] U.S. Cl. ..... 446/267; 446/268; 446/385

[58] Field of Search ..... 446/224, 226, 267, 268, 446/369, 370, 373, 486, 385, 72–74

[56] References Cited

U.S. PATENT DOCUMENTS

| | | | |
|---|---|---|---|
| 1,218,852 | 3/1917 | Gilpin | 446/224 |
| 1,341,985 | 6/1920 | Kemp | 446/267 |
| 4,169,336 | 10/1979 | Kuhn | 446/267 |
| 4,204,110 | 5/1980 | Smit et al. | 446/72 |
| 4,236,347 | 12/1980 | Fauls | 446/267 |
| 4,242,830 | 1/1981 | Hauser | 446/267 |
| 4,568,298 | 2/1986 | Acree | 446/74 |
| 4,694,829 | 9/1987 | Frye | 446/74 |
| 4,816,000 | 3/1989 | Hsu | 446/74 |
| 4,944,363 | 7/1990 | Osher et al. | 446/267 |
| 4,952,190 | 8/1990 | Tarnoff et al. | 446/267 |
| 4,979,923 | 12/1990 | Tanaka | 446/267 |
| 5,006,089 | 4/1991 | Lee | 446/267 |
| 5,050,598 | 9/1991 | Tucker | 446/74 |
| 5,167,561 | 12/1992 | Rizzo | 446/224 |
| 5,224,863 | 7/1993 | Lauer et al. | 446/224 |

FOREIGN PATENT DOCUMENTS

| | | | |
|---|---|---|---|
| 8118 | of 1915 | United Kingdom | 446/226 |

*Primary Examiner*—Robert A. Hafer
*Assistant Examiner*—Jeffrey D. Carlson

[57] ABSTRACT

A giant gummy bear is provided which consists of a pre-molded stretchable bladder in a shape of a bear with a check valve for filling gelatin solution into the bladder. A nylon cloth skin with a bear face is placed about the bladder, so as to simulate a large gummy bear candy. In a first modification the bladder is transparent and the gelatin solution has colored glitter particles therein, so that the nylon cloth skin can be eliminated. In a second modification the nose has an aperture therethrough to the check valve, so that a pump nozzle can be inserted to allow the gelatin solution to be inserted into the bladder.

1 Claim, 1 Drawing Sheet

GIANT GUMMY BEAR

BACKGROUND OF THE INVENTION

The instant invention relates generally to toy figures and more specifically it relates to a giant gummy bear, which provides a bladder filled with a gelatin solution covered by a cloth skin to simulate a gummy bear candy.

There are available various conventional toy figures which do not provide the novel improvements of the invention herein disclosed.

SUMMARY OF THE INVENTION

A primary object of the present invention is to provide a giant gummy bear that will overcome the shortcomings of the prior art devices.

Another object is to provide a giant gummy bear that includes a pre-molded rubber bladder in the shape of a bear filled with a gelatin solution, which can be covered by a nylon cloth skin, so as to simulate a large gummy bear.

An additional object is to provide a giant gummy bear in which the bladder can be transparent and the gelatin solution colored, sot hat the cloth skin can be eliminated to better simulate the gummy bear candy.

A further object is to provide a giant gummy bear that is simple and easy to use.

A still further object is to provide a giant gummy bear that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
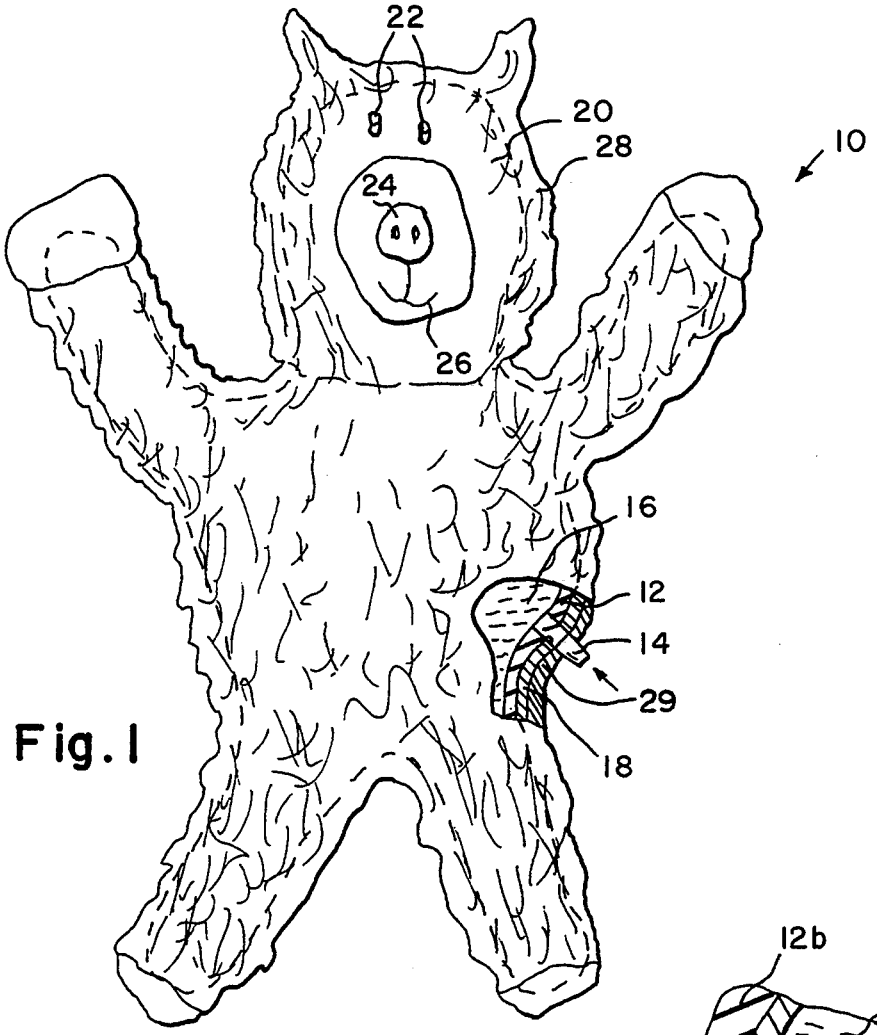
FIG. 1 is a front elevational view of the instant invention with parts broken away and in section.

Turning now descriptively to the drawings, in which similar reference characters denote similar elements throughout the several views, the FIG. 1 illustrates a giant gummy bear 10, which consists of a pre-molded stretchable bladder 12 in a shape of a bear. A check valve 14 is in the bladder 12 for filling the bladder. A gelatin solution 16 is inserted through the check valve 14 and into the bladder 12. A nylon cloth skin 18 is placed about the bladder 12. A face 20 of a bear having eyes 22, nose 24 and mouth 26 is placed upon the nylon cloth skin 18 at a head area 28, so as to simulate a large gummy bear candy.

The gelatin solution 16 includes mixed ingredients of approximately sixty percent corn syrup, twenty five percent gelatin and fifteen percent water, to produce a similar consistency as pliable candy. A plush covering 29 of simulated fur can surround the nylon cloth skin 18 as an optional feature.

Figure 2:
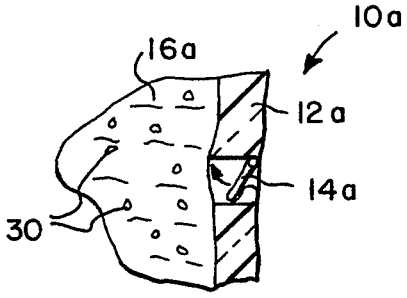
FIG. 2 is a cross sectional view of a portion of a first modification, in which the bladder is transparent and the gelatin solution colored with colored glitter particles, so that the nylon cloth skin can be omitted.

A portion of a modified giant gummy bear **10*a*, is shown in FIG. 2, which contains a pre-molded stretchable transparent bladder 12*a* in a shape of a bear. A check valve 14*a* is in the bladder 12*a*, for filling said bladder. A gelatin solution 16*a*, having colored glitter particles 30 therein is inserted through the check valve 14*a* and into the bladder 12*a*, so as to simulate a large gummy bear candy. The nylon cloth skin 18 and the plush covering 29** are not needed.

Figure 3:
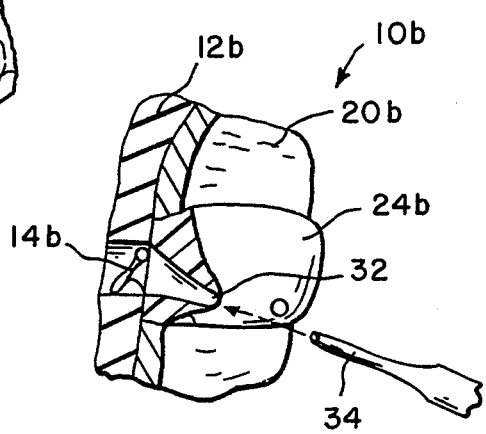
FIG. 3 is a perspective view of a portion of a second modification with parts in section, showing the nose of the bear having a nostril aperture for filling of the bladder through a check valve behind the nostril aperture.

FIG. 3 shows a portion of another modified giant gummy bear **10*b*. The nose portion 24*b* of face 20*b* is plastic and has a nostril aperture 32 therethrough with the check valve 14*b* behind the nostril aperture 32. A pump nozzle 34 can be inserted through the nose aperture 32 and the check valve 14*b*, to allow the gelatin solution 16 to be inserted into the bladder 12*b***.

OPERATION OF THE INVENTION

To use the giant gummy bear 10 a person simply mixes the ingredients of the gelatin solution 16 together and inserts the gelatin solution through the check valve 14 and into the bladder 12, until the bladder is filled up. The giant gummy bear 10 can be squeezed, so as to feel like a large gummy bear candy. The gelatin solution **16*a* with the colored glitter particles 30 can be inserted through the check valve 14*a* and into the bladder 12*a* in the first modified giant gummy bear 10*a*. The other modified giant gummy bear 10*b*, the gelatin solution 16 is inserted with the pump nozzle 34 through the nose aperture 32 past the check valve 14*b* and into the bladder 12*b***.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A flexible toy bear which comprises:

a) a pre-molded stretchable bladder in the shape of a bear;

b) a check valve in said bladder for filling said bladder;

c) a gelatin solution inserted through said check valve and into said bladder;

d) a nylon cloth skin place about said bladder; and e) a face of a bear having eyes, nose and mouth placed upon said nylon cloth skin at a head area, so as to simulate a bear candy; wherein said nose portion of said face is plastic and has a nostril aperture therethrough with said check valve behind said nostil aperture so that a pump nozzle can be inserted through said nose aperture and said check valve to allow said gelatin solution to be inserted into said bladder.

* * * * *